US008399388B2

(12) United States Patent
Campbell et al.

(10) Patent No.: US 8,399,388 B2
(45) Date of Patent: Mar. 19, 2013

(54) LOW TEMPERATURE PERFORMANCE LUBRICATING OIL DETERGENTS AND METHOD OF MAKING THE SAME

(75) Inventors: Curtis Bay Campbell, Hercules, CA (US); Eugene Edward Spala, Fairfield, CA (US); Willie Horn, Jr., Oakland, CA (US)

(73) Assignee: Chevron Oronite Company LLC, San Ramon, CA (US)

( * ) Notice: Subject to any disclaimer, the term of this patent is extended or adjusted under 35 U.S.C. 154(b) by 359 days.

(21) Appl. No.: 12/496,510

(22) Filed: Jul. 1, 2009

(65) Prior Publication Data

US 2011/0003726 A1 Jan. 6, 2011

(51) Int. Cl.
*C10M 129/76* (2006.01)
*C10M 169/00* (2006.01)

(52) U.S. Cl. ..... 508/502; 508/501; 508/523

(58) Field of Classification Search ..... 508/501, 508/502, 523
See application file for complete search history.

(56) References Cited

U.S. PATENT DOCUMENTS

| | | | | |
|---|---|---|---|---|
| 3,036,971 | A | 5/1962 | Otto et al. | |
| 3,932,553 | A | 1/1976 | Robert | |
| 4,514,313 | A | 4/1985 | Le Coent | |
| 4,810,398 | A | 3/1989 | Van Kruchten et al. | |
| 5,942,476 | A | 8/1999 | Campbell | |
| 6,162,770 | A | 12/2000 | Le Coent et al. | |
| 6,262,001 | B1 | 7/2001 | Le Coent et al. | |
| 6,348,438 | B1 | 2/2002 | Le Coent et al. | |
| 2004/0235686 | A1 * | 11/2004 | Boons et al. | 508/460 |

FOREIGN PATENT DOCUMENTS

| | | |
|---|---|---|
| EP | 0933417 | 9/1948 |
| FR | 1563557 | 4/1969 |
| FR | 2625220 | 12/1987 |
| GB | 790473 | 11/1957 |
| GB | 786167 | 2/1958 |
| GB | 1146925 | 3/1969 |
| WO | WO 95/25155 | 9/1995 |

* cited by examiner

*Primary Examiner* — Walter D Griffin
*Assistant Examiner* — Francis C Campanell
(74) *Attorney, Agent, or Firm* — Josetta I. Jones

(57) ABSTRACT

The present invention is directed to a method for preparing an unsulfurized, carboxylate-containing additive for lubricating oils and the product produced by said method, wherein said method comprises a) neutralization of a mixture of at least two alkyl phenols using an alkaline earth base in the presence of a promoter, to produce a mixture of alkyl phenates, wherein the mixture of at least two alkyl phenols comprises at least a first alkyl phenol wherein the alkyl group is derived from an isomerized alpha olefin and a second alkyl phenol wherein the alkyl group is derived from a branched chain olefin; (b) carboxylation of the mixture of alkyl phenates obtained in step (a) using carbon dioxide under carboxylation conditions sufficient to convert at least 20 mole % of the starting alkyl phenols to alkyl salicylate; and (c) removal of at least about 10% of the starting mixture of at least two alkyl phenols from the product produced in step (b) to produce said additive.

17 Claims, No Drawings

LOW TEMPERATURE PERFORMANCE LUBRICATING OIL DETERGENTS AND METHOD OF MAKING THE SAME

FIELD OF THE INVENTION

The present invention relates to a novel unsulfurized, carboxylate-containing additive for lubricating oils, comprising a mixture of alkaline earth metal salts (alkyl salicylate) and a reduced amount of unreacted alkyl phenols, as well as additive packages, concentrates and finished oil compositions comprising the same. Specifically, it relates to additives comprising said mixture in which said alkyl salicylate is primarily single-aromatic-ring alkyl salicylate. This additive improves low temperature performance, antioxidant properties, high temperature deposit control, BN retention, corrosion control and black sludge control in lubricating oils. This invention is also directed, in part, to methods of preparing and using said novel additive.

BACKGROUND OF THE INVENTION

The preparation of alkyl phenates and alkyl salicylates is known in the art.

U.S. Pat. No. 3,036,971 discloses preparing detergent dispersant additives based on sulfurized alkylphenates of high basicity alkaline earth metals. These additives are prepared by sulfurization of an alkylphenol, neutralization of the sulfurized alkylphenol with an alkaline earth metal base, then super-alkalization by carbonation of the alkaline earth metal base dispersed in the sulfurized alkylphenate.

French Patent No. 1,563,557 discloses detergent additives based on sulfurized calcium alkylsalicylates. These additives are prepared by carboxylation of a potassium alkylphenate, exchange with calcium chloride, then sulfurization of the calcium alkylsalicylate obtained with sulfur in the presence of lime, a carboxylic acid and an alkylene glycol or alkyl ether of alkylene glycol.

French Published Patent Application 2,625,220 discloses superalkalized detergent-dispersant additives based on alkylphenates and alkylsalicylates. These additives are prepared by neutralization of an alkylphenol with an alkaline earth metal base in the presence of an acid and a solvent, distillation of the solvent, carboxylation, sulfurization and superalkalization by sulfur and an alkaline earth metal base in the presence of glycol and solvent, followed by carbonation and filtration.

PCT Patent Application Publication No. WO 95/25155 discloses a process that is able to improve substantially the performance of these additives, particularly in the tests relating to foaming, compatibility and dispersion in a new oil, and in the tests of stability towards hydrolysis. This process comprises neutralization with alkaline earth metal base of a mixture of linear and branched alkylphenols in the presence of a carboxylic acid, carboxylation by the action of carbon dioxide of the alkylphenate, followed by sulfurization and superalkalization, then carbonation, distillation, filtration, and degassing in air.

European Patent Application Publication No. 0933417 discloses an unsuffurized, alkali metal-free detergent-dispersant additive, comprising a mixture of alkaline earth metal salts (alkylphenate/alkylsalicylate) and unreacted alkylphenol. This additive improves antioxidant properties, high temperature deposit control, and black sludge control.

U.S. Pat. Nos. 6,162,770 and 6,262,001 teach an unsulfurized, alkali metal-free, detergent-dispersant composition having from 40% to 60% alkylphenol, from 10% to 40% alkaline earth alkylphenate, and from 20% to 40% alkaline earth single-aromatic-ring alkylsalicylate, and a process for preparing the same. This composition may have an alkaline earth double-aromatic-ring alkylsalicylate as long as the mole ratio of single-ring alkylsalicylate to double-aromatic-ring alkylsalicylate is at least 8:1. This composition may be produced by the three-step process involving neutralization of alkylphenols, carboxylation of the resulting alkylphenate, and filtration of the product of the carboxylation step. The detergent-dispersant produced by the method can be used in an engine lubricating composition to improve antioxidant properties, high temperature deposit control, and black sludge control.

SUMMARY OF THE INVENTION

The present invention is directed to a method for preparing an unsulfurized, carboxylate-containing additive for lubricating oils, said method comprising:

a) neutralization of a mixture of at least two alkyl phenols using an alkaline earth base in the presence of a promoter, to produce a mixture of alkyl phenates, wherein the mixture of at least two alkyl phenols comprises at least a first alkyl phenol wherein the alkyl group is derived from an isomerized alpha olefin and a second alkyl phenol wherein the alkyl group is derived from a branched chain olefin;

(b) carboxylation of the mixture of alkyl phenates obtained in step (a) using carbon dioxide under carboxylation conditions sufficient to convert at least 20 mole % of the starting alkyl phenols to alkyl salicylate; and (c) removal of at least about 10% of the starting mixture of at least two alkyl phenols from the product produced in step (b) to produce said additive.

DETAILED DESCRIPTION OF THE INVENTION

In its broadest aspect, the present invention provides an unsulfurized, carboxylate-containing additive comprising alkyl phenol, alkaline earth metal alkyl phenate, and alkaline earth metal single-aromatic-ring alkyl salicylate useful for improving low temperature performance, BN retention, corrosion performance, bulk oxidation, high temperature deposit control, black sludge control, thermal oxidation stability, and other properties of a lubricating oil.

Prior to discussing the invention in further detail, the following terms will be defined:

Definitions

As used herein the following terms have the following meanings unless expressly stated to the contrary:

The term "alkyl" means an alkyl or alkenyl group.

The term "metal" means alkali metals, alkaline earth metals, or mixtures thereof.

The term "alkaline earth metal" means calcium, barium, magnesium, strontium, or mixtures thereof.

The term "salicylate" means a metal salt of a salicylic acid.

The term "alkaline earth metal single-aromatic-ring alkyl salicylate" means an alkaline earth metal salt of an alkyl salicylic acid, wherein there is only one alkyl salicylic anion per each alkaline earth metal base cation.

The term "alkaline earth metal single-aromatic-ring alkylsalicylate" means an alkaline earth metal single-aromatic-ring alkyl salicylate wherein the alkyl group is an alkyl group.

The term "alkaline earth metal double-aromatic-ring alkyl salicylate" means an alkaline earth metal salt of a alkyl salicylic acid, wherein there are two alkyl salicylic anions per each alkaline earth metal base cation.

The term "alkaline earth metal double-aromatic-ring alkylsalicylate" means an alkaline earth metal double-aromatic-ring alkyl salicylate wherein the alkyl groups are alkyl groups.

The term "alkylphenol" means a phenol having one or more alkyl substituents, wherein at least one of the alkyl substituents has a sufficient number of carbon atoms to impart oil solubility to the phenol.

The term "phenate" means a metal salt of a phenol.

The term "alkyl phenate" means a metal salt of an alkyl phenol.

The term "alkaline earth metal alkyl phenate" means an alkaline earth metal salt of an alkyl phenol.

The term "alkaline earth metal alkylphenate" means an alkaline earth metal salt of an alkylphenol.

The term "phenate-stearate" means a phenate that has been treated with stearic acid or anhydride or salt thereof.

The term "long-chain carboxylic acid" means a carboxylic acid having an alkyl group having an average carbon number of from 13 to 28. The alkyl group may be linear, branched, or mixtures thereof.

The term "carboxy-stearate" means an alkaline earth metal single-aromatic-ring alkyl salicylate that has been treated with a long-chain carboxylic acid, anhydride or salt thereof.

The term "Base Number" or "BN" refers to the amount of base equivalent to milligrams of KOH in one gram of sample. Thus, higher BN numbers reflect more alkaline products, and therefore a greater alkalinity reserve. The BN of a sample can be determined by ASTM Test No. D2896 or any other equivalent procedure.

The term "Acid Index" or AI, which also may be known as the Salicylic Acid Index, the quantity of alkylsalicylate formed in the detergent-dispersant. It was determined by acidification of the product by a strong acid (hydrochloric acid) in the presence of diethyl ether, followed by a potentiometric titration on the organic fraction (tetra n-butyl ammonium hydroxide was used as a titration agent). Results are expressed in equivalent mg KOH per gram of product (Base Number unit).

Unless otherwise specified, all percentages are in weight percent.

Preparation of the Lubricant Additive Composition of the Present Invention

A. Neutralization Step

In the first step, a mixture of at least two alkyl phenols is neutralized in the presence of a promoter. In one embodiment, said mixture of at least two alkyl phenols is neutralized using an alkaline earth metal base in the presence of at least one $C_1$ to $C_4$ carboxylic acid thereby producing a mixture of alkyl phenates. Preferably, this reaction is carried out in the absence of alkali base, and in the absence of di-alcohol or mono-alcohol.

The mixture of at least two alkylphenols may contain at least two alkyl phenols, preferably a first alkyl phenol and a second alkyl phenol. Furthermore, the alkyl group on at least one of the at least two alkyl phenols is derived from an isomerized alpha olefin. The alkyl group on the second alkyl phenol may be derived from branched or partially branched olefins, highly isomerized olefins or mixtures thereof. These olefins are the alkylating agents that are employed to alkylate the phenol.

Olefins

As mentioned above, the olefins employed in this invention may be isomerized olefins, branched or partially branched olefins or mixtures thereof. The olefins may be a mixture of isomerized normal alpha olefins, a mixture of branched olefins, a mixture of partially branched linear or a mixture of any of the foregoing.

Isomerized Olefins

In one embodiment of the present invention, normal alpha olefins (NAO) are isomerized using at least one of a solid or liquid catalyst. The normal alpha olefins may be a mixture of NAO's selected from olefins having from about 12 to 30 carbon atoms per molecule. More preferably, the normal alpha olefin mixture is selected from olefins having from about 14 to about 28 carbon atoms per molecule. Most preferably, the normal alpha olefin mixture is selected from olefins having from about 18 to 24 carbon atoms per molecule.

The NAO isomerization process can be either a batch, semi-batch, continuous fixed bed or combination of these processes using homogenous or heterogenous catalysts. A solid catalyst preferably has at least one metal oxide and an average pore size of less than 5.5 angstroms. More preferably, the solid catalyst is a molecular sieve with a one-dimensional pore system, such as SM-3, MAPO-11, SAPO-11, SSZ-32, ZSM-23, MAPO-39, SAPO-39, ZSM-22 or SSZ-20. Other possible solid catalysts useful for isomerization include ZSM-35, SUZ-4, NU-23, NU-87 and natural or synthetic ferrierites. These molecular sieves are well known in the art and are discussed in Rosemarie Szostak's Handbook of Molecular Sieves (New York, Van Nostrand Reinhold, 1992) which is herein incorporated by reference for all purposes. A liquid type of isomerization catalyst that can be used is iron pentacarbonyl ($Fe(CO)_5$).

The process for isomerization of normal alpha olefins may be carried out in batch or continuous mode. The process temperatures may range from about 50° C. to about 250° C. In the batch mode, a typical method used is a stirred autoclave or glass flask, which may be heated to the desired reaction temperature. A continuous process is most efficiently carried out in a fixed bed process. Space rates in a fixed bed process can range from 0.1 to 10 or more weight hourly space velocity.

In a fixed bed process, the isomerization catalyst is charged to the reactor and activated or dried at a temperature of at about 150° C. under vacuum or flowing inert, dry gas. After activation, the temperature of the isomerization catalyst is adjusted to the desired reaction temperature and a flow of the olefin is introduced into the reactor. The reactor effluent containing the partially-branched, isomerized olefins is collected. The resulting partially-branched, isomerized olefins contain a different olefin distribution (i.e., alpha olefin, beta olefin; internal olefin, tri-substituted olefin, and vinylidene olefin) and branching content than the unisomerized olefin and conditions are selected in order to obtain the desired olefin distribution and the degree of branching.

The resulting isomerized alpha olefin (IAO) is composed of between from about 15 to about 80 wt % branching and preferably preferred from about 20 to about 50 wt % branching and has from about 20 to about 24 carbon atoms.

Branched Olefins

In one embodiment, the alkyl group in at least one alkylphenol is derived from a branched olefin. In one embodiment, branched alkylphenols can be obtained by reaction of phenol with a branched olefin, which may be derived from propylene. Branched alkylphenols may consist of a mixture of monosubstituted isomers, the great majority of the substituents being in the para position, very few being in the ortho position, and hardly any in the meta position. That makes them relatively more reactive towards an alkaline earth metal base, since the phenol hydroxyl functionality is practically devoid of steric hindrance.

The term "branched olefins" refers to a class of olefins comprising one or more alkyl branches per linear straight chain containing the double bond, wherein the alkyl branch may be a methyl group or higher. Preferably, the branched olefins contain at least nine carbon atoms, preferably about 8 to about 20 carbon atoms, more preferably 10 to 18 carbon atoms.

In one embodiment, the branched olefins employed are a mixture of branched olefins which are preferably selected from polyolefins which may be derived from $C_3$ or higher monoolefins (i.e., propylene oligomers, butylenes oligomers, or co-oligomers etc.).

In one embodiment, the mixture of branched olefins is either propylene oligomers or butylenes oligomers or mixtures thereof.

In one embodiment, the branched olefins are $C_{10}$ to $C_{18}$ propylene oligomers.

The branched olefins of appropriate molecular weight may be prepared by olefin oligomerization processes such as the action of an appropriate catalyst on propylene. Examples of catalytic propylene oligomerization processes suitable for the present invention are the well known phosphoric acid or boron trifluoride catalyzed oligomerizations. U.S. Pat. No. 3,932,553 provides examples of suitable oligomerization processes.

Highly Isomerized Olefins

In one embodiment, the second alkyl group in the at least one alkylphenol is derived from a highly isomerized, low molecular weight olefin. The highly isomerized alkylphenol may be obtained by the reaction of phenol with a highly isomerized low molecular weight olefin. Typically, these highly isomerized low molecular weight olefins will have from about 8-20 carbon atoms and 60-80 wt % branching. Preferably, these olefins will have from about 10 to 18 carbon atoms. Specifically, 60-80% of the molecules have methyl branching off of the olefin chain. These olefins are prepared according to well known methods in the art.

The highly isomerized low molecular weight olefins employed in the present invention are generally prepared by the process employed to make isomerized normal alpha olefins. However, the preparation of highly isomerized olefins usually occurs at a higher temperature range typically from about 150° C. to about 250° C. Additionally, highly isomerized olefins are prepared with a lower space velocity in the reaction chamber, typically 0.1-2.0 weight hourly space velocity (WHSV).

A. Neutralization Step

The alkaline earth metal bases that can be used for carrying out this step include the oxides or hydroxides of calcium, magnesium, barium, or strontium, and particularly of calcium oxide, calcium hydroxide, magnesium oxide, and mixtures thereof. In one embodiment, slaked lime (calcium hydroxide) is preferred.

The promoter used in this step can be any material that enhances neutralization. For example, the promoter may be a polyhydric alcohol, dialcohol, monoalcohol, ethylene glycol or any carboxylic acid. Preferably, a carboxylic acid is used. More preferably, $C_1$ to $C_4$ carboxylic acids are used in this step including, for example, formic, acetic, propionic and butyric acid, and may be used alone or in mixture. Preferably, a mixture of acids is used, most preferably a formic acid/acetic acid mixture. The molar ratio of formic acid/acetic acid should be from 0.2:1 to 100:1, preferably between 0.5:1 and 4:1, and most preferably 1:1. The carboxylic acids act as transfer agents, assisting the transfer of the alkaline earth metal bases from a mineral reagent to an organic reagent.

The neutralization operation is carried out at a temperature of at least 200° C., preferably at least 215° C., and more preferably at least 240° C. The pressure is reduced gradually below atmospheric in order to distill off the water of reaction. Accordingly the neutralization should be conducted in the absence of any solvent that may form an azeotrope with water. Preferably, the pressure is reduced to no more than 7,000 Pa (70 mbars).

The quantities of reagents used should correspond to the following molar ratios: (1) alkaline earth metal base/alkyl phenol of 0.2:1 to 0.7:1, preferably 0.3:1 to 0.5:1; and (2) carboxylic acid/alkyl phenol of 0.01:1 to 0.5:1, preferably from 0.03:1 to 0.15:1.

Preferably, at the end of this neutralization step the alkyl phenate obtained is kept for a period not exceeding fifteen hours at a temperature of at least 215° C. and at an absolute pressure of between 5,000 and $10^5$ Pa (between 0.05 and 1.0 bar). More preferably, at the end of this neutralization step the alkyl phenate obtained is kept for between two and six hours at an absolute pressure of between 10,000 and 20,000 Pa (between 0.1 and 0.2 bar).

By providing that operations are carried out at a sufficiently high temperature and that the pressure in the reactor is reduced gradually below atmospheric, the neutralization reaction is carried out without the need to add a solvent that forms an azeotrope with the water formed during this reaction.

B. Carboxylation Step

The carboxylation step is conducted by simply bubbling carbon dioxide into the reaction medium originating from the preceding neutralization step and is continued until at least 20 mole % of the starting alkyl phenols is converted to alkyl salicylate (measured as salicylic acid by potentiometric determination). It must take place under pressure in order to avoid any decarboxylation of the alkylsalicylate that forms.

Preferably, at least 22 mole % of the starting alkyl phenols is converted to alkyl salicylate using carbon dioxide at a temperature of between 180° C. and 240° C., under a pressure within the range of from above atmospheric pressure to $15\times10^5$ Pa (15 bars) for a period of one to eight hours.

According to one variant, at least 25 mole % of the starting alkyl phenols is converted to alkyl salicylate using carbon dioxide at a temperature equal to or greater than 200° C. under a pressure of $4\times10^5$ Pa (4 bars).

C. Filtration Step

The product of the carboxylation step may advantageously be filtered. The purpose of the filtration step is to remove sediments, and particularly crystalline calcium carbonate, which might have been formed during the preceding steps, and which may cause plugging of filters installed in lubricating oil circuits.

D. Removal Step

At least 10% of the starting alkyl phenol is removed from the product of the carboxylation step. Preferably, the separation is accomplished using distillation. More preferably, the distillation is carried out in a wiped film evaporator at a temperature of from about 150° C. to about 250° C. and at a pressure of about 0.1 to about 4 mbar; more preferably from about 190° C. to about 230° C. and at about 0.5 to about 3 mbar; most preferably from about 195° C. to about 225° C. and at a pressure of about 1 to about 2 mbar. At least 10% of the starting alkyl phenol is removed. More preferably, at least 30% of the starting alkyl phenol is removed. Most preferably, up to 55% of the starting alkyl phenol is separated. The separated alkyl phenol may then be recycled to be used as starting materials in the novel process or in any other process.

Unsulfurized, Carboxylate-Containing Additive

The unsulfurized, carboxylate-containing additive formed by the present process can be characterized by its unique composition, with much more alkaline earth metal single-aromatic-ring alkyl salicylate and less alkyl phenol than produced by other routes. When the alkyl group is an alkyl group, the unsulfurized, carboxylate-containing additive has the following composition; (a) less than 40% alkylphenol, (b) from 10% to 50% alkaline earth metal alkylphenate, and (b) from 15% to 60% alkaline earth metal single-aromatic-ring alkylsalicylate.

Unlike alkaline earth metal alkylsalicylates produced by other process, this unsulfurized, carboxylate-containing additive composition can be characterized by having only minor amounts of an alkaline earth metal double-aromatic-ring alkylsalicylates. The mole ratio of single-aromatic-ring alkylsalicylate to double-aromatic-ring alkylsalicylate is at least 8:1.

Characterization of the Single Ring AlkylSalicylate Carboxylate Product by Infrared Spectrometry Out-of-aromatic-ring-plane C—H bending vibrations were used to characterize the unsulfurized carboxylate-containing additive of the present invention. Infrared spectra of aromatic rings show strong out-of-plane C—H bending transmittance band in the 675 870 $cm^{-1}$ region, the exact frequency depending upon the number and location of substituents. For ortho-disubstituted compounds, transmittance band occurs at 735 770 $cm^{-1}$. For para-disubstituted compounds, transmittance band occurs at 810 840 $cm^{-1}$.

Infrared spectra of reference chemical structures relevant to the present invention indicate that the out-of-plane C—H bending transmittance band occurs at 750.+−0.3 $cm^{-1}$ for ortho-alkylphenols, at 760.+−0.2 $cm^{-1}$ for salicylic acid, and at 832+3 $cm^{-1}$ for para-alkylphenols.

Alkaline earth alkylphenates known in the art have infrared out-of-plane C—H bending transmittance bands at 750.+−0.3 $cm^{-1}$ and at 832.+−0.3 $cm^{-1}$. Alkaline earth alkylsalicylates known in the art have infrared out-of-plane C—H bending transmittance bands at 763.+−0.3 $cm^{-1}$ and at 832.+−0.3 $cm^{-}$.

The unsulfurized carboxylate-containing additive of the present invention shows essentially no out-of-plane C—H bending vibration at 763.+−0.3 $cm^{-1}$, even though there is other evidence that alkylsalicylate is present. This particular characteristic has not been fully explained. However, it may be hypothesized that the particular structure of the single aromatic ring alkylsalicylate prevents in some way this out-of-plane C—H bending vibration. In this structure, the carboxylic acid function is engaged in a cyclic structure, and thus may generate increased steric hindrance in the vicinity of the aromatic ring, limiting the free motion of the neighbor hydrogen atom. This hypothesis is supported by the fact that the infrared spectrum of the acidified product (in which the carboxylic acid function is no longer engaged in a cyclic structure and thus can rotate) has an out-of-plane C—H transmittance band at 763.+−0.3 $cm^{-1}$.

The unsulfurized carboxylate-containing additive of the present invention can thus be characterized by having a ratio of infrared transmittance band of out-of-plane C—H bending at about 763.+−0.3 $cm^{-1}$ to out-of-plane C—H bending at 832.+−0.3 $cm^{-1}$ of less than 0.1:1.

The unsulfurized, carboxylate-containing additive formed by this method, being non-sulfurized, would provide improved high temperature deposit control performance over sulfurized products. Being alkali-metal free, this additive can be employed as a detergent-dispersant in applications, such as marine engine oils, where the presence of alkali metals have proven to have harmful effects.

Detergents

The unsulfurized, carboxylate-containing additive formed by the process described above has been found to provide improved low temperature performance, bulk oxidation and corrosion control performance when combined with other additives, including detergents.

Detergents help control varnish, ring zone deposits, and rust by keeping insoluble particles in colloidal suspension. Metal-containing (or ash-forming detergents) function both as detergents to control deposits, and as acid neutralizers or rust inhibitors, thereby reducing wear and corrosion and extending engine life. Detergents generally comprise a polar head with a long hydrophobic tail; with the polar head comprising a metal salt of an acidic organic compound. The salts may contain a substantially stoichiometric amount of the metal in which case they are usually described as normal or neutral salts, and would typically have a total base number (as measured by ASTM D2896) of from 0 to 10. It is possible to include large amounts of a metal base by reacting an excess of a metal compound such as an oxide or hydroxide with an acidic gas such as carbon dioxide to form an overbased detergent. Such overbased detergents may have a total base number of about 15 to 30 (low overbased); 31 to 170 (medium overbased); 171 to 400 (high overbased); or above 400 (high-high overbased).

Detergents that may be used include phenates, overbased phenates and sulfurized phenates; phenate-carboxylates, and overbased phenate-carboxylates; carboxy-stearates and overbased carboxy-stearates; and low, medium and high overbased salicylates. Suitable metals include the alkali or alkaline earth metals, e.g., sodium, potassium, lithium, calcium, and magnesium. The most commonly used metals are calcium and magnesium, which may both be present in detergents used in a lubricant.

Preparation of Phenates

The phenates which may be used with the present invention are typically alkyl substituted phenates in which the alkyl substituent or substituents of the phenate are preferably one or more alkyl group, either branched or unbranched. Suitable alkyl groups contain from 4 to 50, preferably from 9 to 28 carbon atoms. Particularly suitable alkyl groups are $C_{12}$ groups derivable from propylene tetramer. The alkyl substituted phenates are typically sulfurized.

According to one embodiment of the present invention, overbased sulfurized alkylphenates of alkaline earth metals are prepared by neutralizing a sulfurized alkylphenol with an alkaline earth base in the presence of a dilution oil, a glycol, and halide ions, the glycol being present in the form of a mixture with an alcohol having a boiling point above 150° C., removing alcohol, glycol, water, and sediment, carbonating the reaction medium with $CO_2$ in the presence of halide ions, and again removing alcohol, glycol, water, and sediment.

In another preferred embodiment, an overbased, sulfurized alkyl phenate is prepared by a process comprising the steps of: (a) neutralizing a sulfurized alkylphenol with an alkaline earth base in the presence of a dilution oil, a glycol, and halide ions, the glycol being present in the form of a mixture with an alcohol having a boiling point above 150° C.; (b) removing alcohol, glycol, and water from the medium, preferably by distillation; (c) removing sediment from the medium, preferably by filtration; (d) carbonating the resultant medium with $CO_2$ in the presence of halide ions; and (e) removing alcohol, glycol, and water from the medium, preferably by distillation.

The alkaline earth bases useful in the above process include the oxides and hydroxides of barium, strontium, and calcium, particularly lime. Alcohols with a boiling point above 150° C. useful in the process include alcohols of $C_6$ to $C_{14}$ such as ethylhexanol, oxoalcohol, decylalcohol, tridecylalcohol; alkoxyalcohols such as 2-butoxyethanol, 2-butoxypropanol; and methyl ethers of dipropylene glycol. The amines useful in the process include polyaminoalkanes, preferably polyaminoethanes, particularly ethylenediamine, and aminoethers, particularly tris(3-oxa-6-amino-hexyl)amine. The glycols useful in the process include alkylene glycols, particularly ethylene glycol. The halide ions employed in the process are preferably $Cl^{-ions}$ in which may be added in the form of ammonium chloride or metal chlorides such as calcium chloride or zinc chloride.

The dilution oils suitable for use in the above process include naphthenic oils and mixed oils and preferably paraffinic oils such as neutral 100 oil. The quantity of dilution oil used is such that the amount of oil in the final product constitutes from about 25% to about 65% by weight of the final product, preferably from about 30% to about 50%.

The process outlined above is more fully described in U.S. Pat. No. 4,514,313, which is incorporated by reference into this application.

Preparation of Phenate-Carboxylates

The phenate-carboxylates which may be used in the present invention are typically alkyl substituted phenate-carboxylates in which the alkyl substituent or substituents of the phenate are preferably one or more alkyl group, either branched or unbranched. Suitable alkyl groups contain from 4 to 50, preferably from 9 to 28 carbon atoms. Particularly suitable alkyl groups are $C_{12}$ groups derivable from propylene tetramer. The alkyl substituted phenate-carboxylates may be sulfurized or unsulfurized.

The overbased alkyl phenate-carboxylate is prepared from an overbased alkyl phenate which has been treated, either before, during, or subsequent to overbasing, with a long-chain carboxylic acid (preferably stearic acid), anhydride or salt thereof. That process comprises contacting a mixture of an alkyl phenate, at least one solvent, metal hydroxide, aqueous metal chloride, and an alkyl polyhydric alcohol containing from one to five carbon atoms, with carbon dioxide under overbasing reaction conditions. Using an aqueous metal chloride, instead of a solid metal chloride, reduces the viscosity of the product. Preferably, the metals are alkaline earth metals, most preferably calcium. Preferably, the alkyl polyhydric alcohol is ethylene glycol.

In a preferred embodiment, the overbased phenate-carboxylate is produced by overbasing a alkyl phenate and treating the phenate (before, during, or after overbasing) with a long-chain carboxylic acid (preferably stearic acid), anhydride or salt thereof.

In the overbasing step, a mixture comprising alkyl phenate (which can be sulfurized or unsulfurized), at least one solvent, metal hydroxide, aqueous metal chloride, and an alkyl polyhydric alcohol containing from one to five carbon atoms is reacted with carbon dioxide under overbasing reaction conditions. Overbasing reaction conditions include temperatures of from 250 to 375° F. at approximately atmospheric pressure.

Preferably, the overbased alkyl phenate is a sulfurized alkylphenate. Preferably, the metal is an alkaline earth metal, more preferably calcium. Preferably, the alkyl polyhydric alcohol is ethylene glycol.

The carboxylate treatment (treatment with long-chain carboxylic acid, anhydride, or salt thereof) can occur before, during, or after the overbasing step. It is unimportant when the treatment with long-chain carboxylic acid, anhydride, or salt thereof occurs relative to the overbasing step.

The phenate can be sulfurized or unsulfurized. Preferably, the phenate is sulfurized. If the phenate is sulfurized, the sulfurization step can occur anytime prior to overbasing. More preferably, the phenate is sulfurized before the overbasing step but after the carboxylate treatment.

The process outlined above is more fully described in U.S. Pat. No. 5,942,476, which is incorporated by reference into this application.

Preparation of Salicylates

The preparation of salicylates is well known in the art. Preferred salicylates which may be used in the present invention include medium and high overbased salicylates including salts of polyvalent or monovalent metals, more preferably monovalent, most preferably calcium. As used herein, medium overbased (MOB) is meant to include salicylates with a TBN of about 31 to 170. High overbased (HOB) is meant to include salicylates with a TBN from about 171 to 400. High-high overbased (HHOB) is meant to include salicylates with a TBN over 400.

In one embodiment, salicylates may be prepared, for instance, starting from phenol, ortho-alkylphenol, or para-alkylphenol, by alkylation, carboxylation and salt formation. The alkylating agent preferably chosen is an olefin or a mixture of olefins with more than 12 carbon atoms to the molecule. Acid-activated clays are suitable catalysts for the alkylation of phenol and ortho- and para-alkylphenol. The amount of catalyst employed is, in general, 1 10 wt %, in particular, 3 7 wt %, referred to the sum of the amounts by weight of alkylating agent and phenol to be alkylated. The alkylation may be carried out at temperatures between 100 and 250° C., in particular, between 125 and 225° C.

The alkylphenols prepared via the phenol or ortho- or para-alkylphenol route may be converted into the corresponding alkylsalicylic acids by techniques well known in the art. For instance, the alkylphenols are converted with the aid of an alcoholic caustic solution into the corresponding alkylphenates and the latter are treated with $CO_2$ at about 140° C. and a pressure of 10 to 30 atmospheres. From the alkylsalicylates so obtained, the alkylsalicylic acids may be liberated with the aid of, for example, 30% sulfuric acid.

For the preparation of overbased salicylates, the alkylsalicylic acids may be treated with an excess amount of a metal compound, for instance, calcium in the form of $Ca(OH)_2$.

For example, the alkylsalicylic acids may be treated with 4 equivalents of calcium in the form of $Ca(OH)_2$ with introduction of 1.6 equivalents of $CO_2$.

The preparation of medium and overbased salicylates is more fully described in U.S. Pat. No. 4,810,398, and GB Patents 1,146,925; 790,473; and 786,167, which are incorporated by reference into this application.

Preparation of Carboxy-Stearates

The carboxy-stearates which may be used in the present invention are typically alkaline earth metal single-aromatic-ring alkyl salicylates that have been treated with a long-chain carboxylic acid, anhydride or salt thereof.

The carboxy-stearate is prepared from a mixture of alkaline earth metal single-aromatic-ring salicylate, at least one solvent, and alkaline earth metal hydroxide. The mixture is overbased by contacting the mixture with carbon dioxide in the presence of an alkyl polyhydric alcohol, wherein the alkyl group of the alcohol has from one to five carbon atoms. One such useful alkyl polyhydric alcohol is ethylene glycol.

The process outlined above is more fully described in U.S. Pat. No. 6,348,438, which is incorporated by reference into this application.

Base Oil of Lubricating Viscosity

The base oil of lubricating viscosity used in such compositions may be mineral oil or synthetic oils of viscosity suitable for use in the crankcase of an internal combustion engine. Crankcase base oils ordinarily have a viscosity of about 1300 cSt at 0° F. (−18° C.) to 3 cSt at 210° F. (99° C.). The base oils may be derived from synthetic or natural sources. Mineral oil for use as the base oil in this invention includes paraffinic, naphthenic and other oils that are ordinarily used in lubricating oil compositions. Synthetic oils include both hydrocarbon synthetic oils and synthetic esters. Useful synthetic hydrocarbon oils include liquid polymers of alpha olefins having the proper viscosity. Especially useful are the hydrogenated liquid oligomers of $C_6$ to $C_{12}$ alpha olefins such as 1-decene trimer. Likewise, alkyl benzenes of proper viscosity, such as didodecyl benzene, can be used. Useful synthetic esters include the esters of monocarboxylic acids and polycarboxylic acids, as well as mono-hydroxy alkanols and polyols. Typical examples are didodecyl adipate, penta-erythritol tetracaproate, di-2-ethylhexyl adipate, dilaurylsebacate, and the like.

Complex esters prepared from mixtures of mono and dicarboxylic acids and mono and dihydroxy alkanols can also be used.

Blends of mineral oils with synthetic oils are also useful. For example, blends of 10 to 25% hydrogenated 1-decene trimer with 75 to 90% 150 SUS (100° F.) mineral oil make excellent lubricating oil bases.

Other Additive Components

The following additive components are examples of some components that can be favorably employed in the present invention. These examples of additives are provided to illustrate the present invention, but they are not intended to limit it:

(1) Ashless dispersants: alkenyl succinimides, alkenyl succinimides modified with other organic compounds, and alkenyl succinimides modified with boric acid, alkenyl succinic ester.

(2) Oxidation inhibitors:

(a) Phenol type oxidation inhibitors: 4,4'-methylene bis(2,6-di-tert-butylphenol), 4,4'-bis(2,6-di-tert-butylphenol), 4,4'-bis(2-methyl-6-tert-butylphenol), 2,2'-methylene bis(4-methyl-6-tert-butyl-phenol), 4,4'-butylidenebis(3-methyl-6-tert-butylphenol), 4,4'-isopropyl-idenebis(2,6-di-tert-butylphenol), 2,2'-methylene-bis(4methyl-6-nonylphenol), 2,2'-isobutylidene-bis(4,6dimethyl-phenol), 2,2'-methylenebis(4-methyl-6-cyclohexylphenol), 2,6-di-tert-butyl4-methyl-phenol, 2,6-di-tert-butyl4-ethylphenol, 2,4-dimethyl-6-tert-butyl-phenol, 2,6-di-tert-4-(N,N'-dimethyl-aminomethylphenol), 4,4'-thiobis(2-methyl-6-tert-butylphenol), 2,2'-thiobis(4-methyl-6-tert-butylphenol), bis(3-methyl4-hydroxy-5-tert-butyl benzylysulfide, and bis(3,5-di-tert-butyl4-hydroxybenzyl).

(b) Diphenylamine type oxidation inhibitor: alkylated diphenylamine, phenyl-.alpha.-naphthylamine, and alkylated .alpha.-naphthylamine.

(c) Other types: metal dithiocarbamate (e.g., zinc dithiocarbamate), molybdenum oxysulfide succinimide complexes, and methylenebis(dibutyl-dithiocarbamate).

(3) Rust inhibitors (Anti-rust agents)

(a) Nonionic polyoxyethylene surface active agents: polyoxyethylene lauryl ether, polyoxyethylene higher alcohol ether, polyoxyethylene nonylphenyl ether, polyoxyethylene octylphenyl ether, polyoxyethylene octyl stearyl ether, polyoxyethylene oleyl ether, polyoxyethylene sorbitol monostearate, polyoxyethylene sorbitol mono-oleate, and polyethylene glycol monooleate.

(b) Other compounds: stearic acid and other fatty acids, dicarboxilic acids, metal soaps, fatty acid amine salts, metal salts of heavy sulfonic acid, partial carboxylic acid ester of polyhydric alcohol, and phosphoric ester.

(4) Demulsifiers: addition product of alkylphenol and ethyleneoxide, poloxyethylene alkyl ether, and polyoxyethylene sorbitan ester.

(5) Extreme pressure agents (EP agents): zinc dialkyldithiophosphate (aryl zinc, primary alkyl, and secondary alkyl type), sulfurized oils, diphenyl sulfide, methyl trichlorostearate, chlorinated naphthalene, fluoroalkylpolysiloxane, and lead naphthenate.

(6) Friction modifiers: fatty alcohol, fatty acid, amine, borated ester, and other esters.

(7) Multifunctional additives: sulfurized oxymolybdenum dithiocarbamate, sulfurized oxymolybdenum organo phosphoro dithioate, oxymolybdenum monoglyceride, oxymolybdenum diethylate amide, amine-molybdenum complex compound, and sulfur-containing molybdenym complex compound.

(8) Viscosity index improvers: polymethacrylate type polymers, ethylene-propylene copolymers, styrene-isoprene copolymers, hydrated styrene-isoprene copolymers, polyisobutylene, and dispersant type viscosity index improvers.

(9) Pour point depressants: polymethyl methacrylate.

(10) Foam Inhibitors: alkyl methacrylate polymers and dimethyl silicone polymers.

(11) Metal detergents: sulfurized or unsulfurized alkyl or alkenyl phenates, alkyl or alkenyl aromatic sulfonates, sulfurized or unsulfurized metal salts of multi-hydroxy alkyl or alkenyl aromatic compounds, alkyl or alkenyl hydroxy aromatic sulfonates, sulfurized or unsulfurized alkyl or alkenyl naphthenates, metal salts of alkanoic acids, metal salts of an alkyl or alkenyl multiacid, and chemical and physical mixtures thereof.

Lubricating Oil Composition

The unsulfurized, carboxylate-containing additive produced by the process of this invention is useful for imparting detergency to an engine lubricating oil composition. Such a lubricating oil composition comprises a major part of a base oil of lubricating viscosity and an effective amount of the unsulfurized, carboxylate-containing additive of the present invention, typically from about 1% to about 30% by weight, based on the total weight of the lubricating oil composition.

Adding an effective amount the unsulfurized, carboxylate-containing additive of the present invention to a lubricating oil improves the detergency of that lubricating oil in automotive diesel and gasoline engines, as well as in marine engine applications. Such compositions are frequently used in combination with Group II metal detergents, and other additives.

Lubricating marine engines with an effective amount of lubricating oil having the unsulfurized, carboxylate-containing additive of the present invention can control black sludge deposits. It also improves the high temperature deposit control performance and demulsibility performance of that lubricating oil in marine applications.

Adding an effective amount of the unsulfurized, carboxylate-containing additive of the present invention to a lubricating oil improves the high temperature deposit control performance, corrosion control and the oxidation inhibition performance of that lubricating oil in automotive applications.

In one embodiment, an engine lubricating oil composition would contain (a) a major part of a base oil of lubricating viscosity; (b) 1% to 30% of the unsulfurized, carboxylate-containing additive of the present invention; (c) 0% to 20% of at least one ashless dispersant; (d) 0% to 5% of at least one zinc dithiophosphate; (e) 0% to 10% of at least one oxidation inhibitor; (f) 0% to 1% of at least one foam inhibitor; and (g) 0% to 20% of at least one viscosity index improver.

In another embodiment, an engine lubricating oil composition would contain the above components and from 0% to 30% of a metal-containing detergent.

In a further embodiment, an engine lubricating oil composition is produced by blending a mixture of the above components. The lubricating oil composition produced by that method might have a slightly different composition than the initial mixture, because the components may interact. The components can be blended in any order and can be blended as combinations of components.

Hydraulic Oil Composition

A hydraulic oil composition having improved filterability can be formed containing a major part of a base oil of lubricating viscosity, from 0.1% to 6% by weight of the unsulfurized, carboxylate-containing additive of the present invention, and preferably at least one other additive.

Additive Concentrates

Additive concentrates are also included within the scope of this invention. The concentrates of this invention comprise the compounds or compound mixtures of the present invention, with at least one of the additives disclosed above. Typically, the concentrates contain sufficient organic diluent to make them easy to handle during shipping and storage.

From 20% to 80% of the concentrate is organic diluent. From 0.5% to 80% of the concentrate is the unsulfurized, carboxylate-containing additive of the present invention. The unsulfurized, carboxylate-containing additive contains the single-aromatic-ring alkyl salicylate, and possibly alkyl phenol and alkyl phenate. The remainder of the concentrate consists of other additives.

Suitable organic diluents that can be used include mineral oil or synthetic oils, as described above in the section entitled "Base Oil of Lubricating Viscosity." The organic diluent preferably has a viscosity of from about 1 to about 20 cSt at 100° C.

EXAMPLES

The invention will be further illustrated by following examples, which set forth particularly advantageous method embodiments. While the Examples are provided to illustrate the present invention, they are not intended to limit it.

Example 1

Preparation of Linear Alkylphenol

The linear alkylphenol is a commercial alkylphenol manufactured by Chevron Oronite Company LLC and made from a mixture of unisomerized $C_{20-24}/C_{26-28}$ normal alpha olefins (NAO) having a ratio of 80:20 $C_{20-24}$:$C_{26-28}$ obtained from Chevron Phillips Chemical Company. The alkylphenol nominally has the following properties; 1.0% Ether, 3.5% Dialkylate, 40.0% Para-alkyl-isomer, 1.0% free phenol and 0.8% Unreacted olefiniparaffin by HPLC.

Example 2

Measurement of % Branching and % Alpha-Olefin in $C_{20-24}$ Isomerized Alpha Olefins (IAO)

Infrared spectrometry is used to determine the percentage methyl branching and percentage residual alpha-olefin of isomerized $C_{20-24}$ NAO or isomerized alpha olefin (IAO). The technique involves developing a calibration curve between the infrared absorption at 1378 cm−1 (characteristic of the methyl stretch) measured by attenuated reflectance (ATR) infrared spectrometry and the percent branching determined by GLPC analysis of the corresponding hydrogenated IAO samples (hydrogenation converts the IAO to a mixture of paraffin's in which the normal paraffin has the longest retention time for a give carbon number). Similarly, a calibration curve was developed between the infrared absorption at 907 cm−1 (characteristic of alpha olefin C—H stretch) determined by attenuated reflectance (ATR) infrared spectrometry and the percent alpha-olefin determined by quantitative carbon NMR.

A linear least squares fit of data for the percent branching showed the following equation:

% Branching by Hydrogenation $GC$=3.0658 (Peak Height at 1378 cm−1, in mm, by ATR Infrared Spectroscopy)−54.679. The $R2$ was 0.9321 and the branching content of the samples used to generate this calibration equation ranged from approximately 9% to 92%.

Similarily, a linear least squares fit of the percent alpha-olefin data showed the following equation:

% Alpha-Olefin by Carbon NMR=0.5082 (Peak Height at 909 cm−1, in mm, by ATR Infrared Spectroscopy)−2.371. The $R2$ was 0.9884 and the alpha-olefin content of the samples used to generate this calibration equation ranged from approximately 1% to 75%.

Example 3

Preparation of Isomerized $C_{20-24}$ Alpha Olefin

The primary olefinic species in NAO's is normally alpha-olefin. The isomerization of NAO's over the solid acid extrudate catalyst—ICR 502 (which may be purchased from Chevron Lummus Global LLC) isomerizes the alpha-olefin to other olefinic species, such as beta-olefins, internal olefins and even tri-substituted olefins. The isomerization of NAO's over ICR 502 catalyst also induces skeletal isomerization in which methyl groups are introduced along the hydrocarbon chain of the isomerized alpha-olefin (IAO) which is referred to as branching. The branching content of IAO's is monitored by Infrared spectrometry, which is taught in Example 2. The degree of olefin and skeletal isomerization of an NAO depends on the conditions of the isomerization process.

A $C_{20-24}$ Normal Alpha Olefin (obtained from Chevron Phillips Chemical Company) was isomerized in a tubular fixed bed reactor (2.54 cm ID×54 cm Length Stainless Steel) packed sequentially from the bottom of the reactor to the top of the reactor as follows; 145 grams Alundum 24, 40 grams of ICR 505 mixed with 85 grams of Alundum 100, 134 grams of Alundum 24. The reactor was mounted vertically in a temperature controlled electric furnace. The catalyst was dried at approximately 150° C. in a downflow of dry nitrogen of approximately 30 ml/minute. The NAO (heated to approximately 35° C.) was pumped upflow at a WHSV of 1.5 while the catalyst bed was held at temperatures ranging between 130° C. and 230° C. at atmospheric pressure and samples of IAO were collected at the outlet of the reactor with different amounts of branching depending on the reactor temperature.

Example 4

Preparation of Isomerized Alkylphenol I

To a 10 liter, glass, four neck flask fitted with a mechanical stirrer, reflux condenser and thermocouple under a dry nitrogen atmosphere was charged 2210 grams of melted phenol (23.5 moles) followed by 1450 grams (4.7 moles) of the isomerized $C_{20-24}$ alpha-olefin from Example 3 containing 41.4% Branching. To this gently stirring mixture was added 290 grams of Amberlyst 36® acidic ion exchange resin obtained from Rohm and Hass (dried approximately 24 hours in an oven at 105° C. The reaction temperature was increased to 120° C. and held for about 90 hours at which time the conversion was about 42% (by Supercritical Fluid Chromatography—SFC). An additional 100 grams of Amberlyst catalyst was added to the reaction. After 6 hour, the conversion was 97.2% (by SFC). After 27 hours the conversion was 98.4% (by SFC) and an additional 60 grams of Amberlyst catalyst was added to the reaction. After another 23 hours, the conversion was 98.8% (by SFC) and an additional 50 grams of Amberlyst catalyst was added. After 12 hours, the conversion was 99.5% (by SFC). The reaction mixture was cooled to approximately 70° C. and the product was filtered through a Buchner funnel with the aid of vacuum to afford the crude product. This reaction was repeated two more times and the combined filtrates afforded 13.0 kg of crude product. This crude product was vacuum distilled (98 to 108° C. at 50 Torr vacuum, then 94° C. at 30 Torr vacuum and then finally 94-204° C. at 1.0 Torr vacuum using an unpacked 10" by 2" column) to afford 7.0 kg of the alkylphenol 5610 with the following properties: 0.54% Unreacted olefin/paraffin, 9.2% Di-alkylate by Supercritical Fluid Chromatography; 59.8% para-alkyl isomer by IR; 2.8% Ether, 5.6% Di-alkylate, 51.6% Otho-Alkyl-isomer, 39.6% Para-Alkyl-isomer and 0.5% phenol by HPLC.

Example 5

Preparation of Isomerized Alkylphenol II

Following the procedure of Example 4, a second isomerized alkylphenol II was prepared from an isomerized $C_{20-24}$ normal alpha olefin containing 25.6% branching obtained from Example 3 to afford an isomerized alkylphenol with the following properties: 0.3 Unreacted olefin/paraffin, 13.9% Di-alkylate by Supercritical Fluid Chromatography; 54.6% para-alkyl isomer by IR; 3.6% Ether, 6.5% Di-alkylate, 54.2% Ortho-Alkyl-isomer, 35.4% Para-Alkyl-isomer and 0.4% phenol by HPLC.

Example 6

Preparation of 41.4% Branched $C_{20-24}$ Low Overbased (LOB) Single Ring AlkylSalicylate Carboxylate from Alkylphenol I plus Propylene Tetramer Alkylphenol The isomerized alkylphenol I as prepared in Example 4 (700 grams) was charged to a 1 gallon, mechanically stirred metal autoclave reactor fitted with a distillation takeoff and a temperature controlled heating mantle followed by 701 grams of branched alkylphenols as prepared in Example 12 and then 124 grams of lime with stirring. To this mixture was then added 10.63 grams of formic acid, 10.70 grams of acetic acid and 7 drops of foam inhibitor.

This mixture was then heated to 120° C. At 120° C. the pressure was reduced to 0.8 psia while simultaneously heating to 180° C. After reaching 180° C., the temperature was then ramped to 240° C. over 90 minutes and held for 3 hours once this temperature was reached. To avoid loss of low boiling alkylphenol, the autoclave was vented to a reflux column during the temperature ramp and 3 hour hold at 240° C. The top of reflux was controlled at 70° C. to ensure elimination of water from the autoclave.

After the 3 hour hold at 240° C., the pressure was raised to 70 psia using $CO_2$ while simultaneously reducing the reactor temperature to 200° C.

This crude intermediate in the reactor (Crude Sediment=2.0 Vol %) was filtered through a Buchner filter with the aid of vacuum and filter aid (HyFlow® Celite) to afford the filtered intermediate having the following properties: TBN=120.5; Acid Index=41.7; % Ca=4.2; Viscosity=66.7 cSt @100° C. and 2042 cSt @40° C.; Viscosity Index=64.0.

The filtered intermediate (792.1 grams) was vacuum distilled through a one-stage wiped film evaporator (WFE). The WFE (a 0.06 $m^2$ glass unit available from UIC GmbH Model KD6 operated under the following conditions; Evaporator Inlet Temperature=60° C., Evaporator Outlet Temperature=210° C., Wiper Speed=300 rpm, Pressure=1.5 mbar, 200 gms/hour feed rate to afford 465.1 grams of residue product with a TBN=191.2. Approximately 50% of the unreacted alkylphenols were distilled (398.4 grams). The residue product (393.7 grams) was diluted with 107.6 grams of diluent oil (Exxon 100 Neutral) to afford the final Single Ring Alkyl-Salicylate Carboxylate with the following properties: % Ca=5.48, % S=0.11%, TBN=151, Acid Index=53.9 mgKOH/gm of sample; Viscosity=297.9 cSt@100° C. and 5495 cSt@40° C.; VI=188.

Example 6

Preparation of 25.6% Branched $C_{20-24}$ Low Overbased (LOB) Single Ring AlkylSalicylate Carboxylate from Alkylphenol II plus Propylene Tetramer Alkylphenol The procedure of Example 6 was followed using 700 grams of isomerized alkylphenol II from Example 5, 701 grams of branched alkylphenols as prepared in Example 12, 124.1 grams of lime, 10.64 grams of formic acid, 10.76 grams of acetic acid and 7 drops of foam inhibitor and a total of 253 grams of $CO_2$ to afford a crude intermediate (3.6 Vol % sediment) which after filtration, the filtered intermediate had the following properties: TBN=119.6, % Ca=4.17; Acid Index=9.3; Viscosity=50.4 cSt @100° C. and 1663 cSt @40° C.; Viscosity Index=58.0.

The filtered intermediate (896.9 grams) was distilled as described in Example 6 to afford 519.0 grams of residue with a TBN=191.7 (about 42% of the unreacted alkylphenols were distilled off). This residue product (488.0 grams) was diluted with 133.3 grams of diluent oil (Exxon 100 Neutral) to afford the final Single Ring AlkylSalicylate Carboxylate with the following properties: % Ca=5.50, % S=0.14%, TBN=151, Acid Index=52.8 mgKOH/gm of sample; Viscosity=349.6 cSt@100° C. and 6546 cSt@40° C.; VI=196.

Example 10

Preparation of Non-isomerized Linear $C_{20-28}$ Low Overbased (LOB) Single Ring AlkylSalicylate Carboxylate from Linear Alkylphenol plus Propylene Tetramer Alkylphenol The procedures in Example 6 were followed using the commercial non-isomerized linear alkylphenol of Example 1 and commercial branched alkylphenol of Example 12. (about % of the unreacted alkylphenols are removed). The final Single Ring AlkylSalicylate Carboxylate had the following properties: % Ca=5.15, TBN=137, Acid Index=49.9 mgKOH/gm of sample; Viscosity=156 cSt@100° C. and 2586 cSt@40° C.; VI=163.

Example 11

Low Temperature Performance of $C_{20-28}$ Low Overbased (LOB) Single Ring AlkylSalicylate Detergents in an Automotive Formulation Table 11.1 summarizes the low temperature performance of three $C_{20-28}$ LOB Single Ring AlkylSalicylate detergents in the following finished automotive engine oil as measured by the ASTM D-5133 (Scanning Brookfield). The data in Table 11.1 shows that as the percent branching in the alkylchain of the alkylphenol used to prepare the LOB single ring alkylsalicylate detergent increases, the Scanning Brookfield performance is improved.

Finished Automotive Engine Oil Blends

| | | |
|---|---|---|
| LOB Single Ring AlkylSalicylate | mmol Ca | 49 |
| Bis Succinimide | Wt. % | 8.0 |
| Non Carbonated Calcium Sulfonate | mmol Ca | 4.0 |
| Carbonated Calcium Sulfonate | mmol Ca | 11.2 |
| Carbonated Calcium Phenate | mmol Ca | 7.5 |
| Zinc Dithiophosphate | mmol P | 7.5 |
| Aminic Antioxidant | Wt. % | 0.2 |
| Phenolic Antioxidant | Wt. % | 0.5 |
| Foam Inhibitor | ppm | 5 |
| Group II Base Oil 1 | Wt. % | 61.2 |
| Group II Base Oil 2 | Wt. % | 19.45 |
| Viscosity Index Improver | Wt. % | 6.75 |

TABLE 11.1

| | Comparative Example 10 | Example 8 | Example 9 |
|---|---|---|---|
| TBN of Single Ring AlkylSalicylate Detergent | | 151 | 151 |
| Alkylphenol used to prepare Detergent | Linear Alkylphenol (Ex. 1) | Isomerized Alkylphenol (Ex. 4) | Isomerized Alkylphenol (Ex. 5) |
| Carbon Number of the Alkyl Tail in the Alkylphenol | $C_{20-28}$ | $C_{20-24}$ | $C_{20-24}$ |
| % $C_{20-26}$ in the Alkyl Tail of the Alkylphneol | 92-100 | 99 | 99 |
| % Branching in the Olefin Used to Prepare the Alkylphenol | About 0 | 41% | 26% |
| Scanning Brookfield D-5133 | | | |
| Gelation Temperature (° C.) | −26 | −20 | none |
| Gelation Index | 11.6 | 7.6 | <6.0 |

Both the lower Gelation Temperature and the lower Gelation Index values for the LOB Single Ring AlkylSalicylate detergents (Example 8 and 9) with the higher amount of branching in the alkyl tail of the alkylphenol used to prepare the respective detergents show improved low temperature performance compared to Example A.

Example 12

Preparation of Propylene Tetramer Alkylphenol

The branched propylene tetramer alkylphenol is a commercial alkylphenol manufactured by Chevron Oronite Company LLC and made from oligomerized propylene in the $C_{10-C15}$ carbon number range (propylene tetramer) obtained from Chevron Oronite Company LLC. The branched alkylphenol nominally has the following properties; 0.3% Ether, 2.0% Di-alkylate, 90.0% Para-alkyl-isomer, 6.0% Ortho-alkyl-isomer and 0.5% free phenol by HPLC.

While the present invention has been described with reference to specific embodiments, this application is intended to cover those various changes and substitutions that may be made by those skilled in the art without departing from the spirit and scope of the appended claims.

What is claimed is:

1. A method for preparing an unsulfurized, carboxylate-containing additive for lubricating oils, said method comprising:

a) neutralization of a mixture of at least two alkyl phenols using an alkaline earth base in the presence of a promoter, to produce a mixture of alkyl phenates, wherein the mixture of at least two alkyl phenols comprises at least a first alkyl phenol wherein the alkyl group is derived from an isomerized alpha olefin, wherein the isomerized alpha olefin has 15-80 wt % branching, and a second alkyl phenol wherein the alkyl group is derived from a branched chain olefin; (b) carboxylation of the mixture of alkyl phenates obtained in step (a) using carbon dioxide under carboxylation conditions sufficient to convert at least 20 mole % of the starting alkyl phenols to alkyl salicylate; and (c) removal of at least about 10% of the starting mixture of at least two alkyl phenols from the product produced in step (b) to produce said additive.

2. The method of claim 1 wherein the isomerized alpha olefin content has 20-50 wt % branching.

3. The method of claim 1 wherein the mixture of at least two alkylphenols is a mixture of two alkylphenols.

4. The method of claim 1 wherein the branched chain olefin is derived from a propylene oligomer, butylene oligomer or a highly isomerized normal alpha olefin, wherein the highly isomerized olefin has from about 10 to 18 carbon atoms and 60-80 wt % branching.

5. The method of claim 4 wherein the branched chain olefin is a propylene or butylenes oligomer.

6. The method of claim 5 wherein the branched chain olefin is a propylene oligomer having from about 9 to 18 carbon atoms.

7. The method of claim 6 wherein the propylene oligomer is a propylene tetramer.

8. The method of claim 5 wherein the branched chain olefin is a butylene oligomer having from about 8 to about 24 carbon atoms.

9. The method of claim 1 wherein the alkyl group on the first alkylphenol is derived from an isomerized alpha olefin having 15-80 wt % branching and from about 20 to 28 carbon atoms.

10. The method of claim 9 wherein the alkyl group on the first alkylphenol is derived from an isomerized alpha olefin having from about 20 to 24 carbon atoms.

11. The method of claim 9 wherein the alkyl group on the first alkylphenol is derived from an isomerized alpha olefin having 20-50 wt % branching and from about 20 to 28 carbon atoms.

12. The method of claim 1, wherein said alkyl salicylate comprises single-aromatic-ring alkyl salicylate and double-aromatic-ring alkyl salicylate wherein the mole ratio of single aromatic-ring alkyl salicylate to double-aromatic-ring alkyl salicylate is at least 8:1.

13. The method of claim 1, wherein, in said removal step (c), at least about 30% of the starting alkyl phenols is removed from the product produced in step (b) to produce said additive.

14. The method of claim 1, wherein, in said removal step (c), said starting alkyl phenols are removed by distillation.

15. The method of claim 14, wherein said distillation is carried out at temperatures ranging from about 150° C. to about 250° C. and at pressures from about 0.1 to about 4 mbar.

16. The method of claim 15, wherein said distillation is carried out at temperatures ranging from about 190° C. to about 230° C. and at pressures from about 0.5 to about 3 mbar.

17. The method of claim 1, wherein, in said neutralization step; (a) said neutralization operation is carried out in the presence of at least one carboxylic acid containing from one to four carbon atoms, and in the absence of alkali base, dialcohol, and monoalcohol; and (b) said neutralization operation is carried out at a temperature of at least 200° C.; (c) the pressure is reduced gradually below atmospheric in order to remove the water of reaction, in the absence of any solvent that may form an azeotrope with water; (d) said alkyl phenols contain up to 85% of linear alkyl phenol in mixture with at least 15% of branched alkyl phenol in which the branched alkyl radical contains at least nine carbon atoms; and (e) the quantities of reagents used correspond to the following molar ratios: (1) alkaline earth base/alkyl phenol of 0.2:1 to 0.7:1; and (2) carboxylic acid/alkyl phenol of from 0.01:1 to 0.5:1.

* * * * *